US006751911B1

(12) United States Patent
Gates et al.

(10) Patent No.: US 6,751,911 B1
(45) Date of Patent: Jun. 22, 2004

(54) FACIA BORDER

(75) Inventors: J. Larry Gates, Selma, NC (US); Ronald J. Wilkins, Selma, NC (US)

(73) Assignee: Versatile Premium Products, Inc., Smithfield, NC (US)

( * ) Notice: Subject to any disclaimer, the term of this patent is extended or adjusted under 35 U.S.C. 154(b) by 0 days.

(21) Appl. No.: 10/198,835

(22) Filed: Jul. 22, 2002

(51) Int. Cl.[7] ..... E04D 13/00
(52) U.S. Cl. ..... 52/96; 52/94; 52/58; 52/60
(58) Field of Search ..... 52/58, 60, 94, 52/96, 300, 97, 746.1

(56) References Cited

U.S. PATENT DOCUMENTS

| | | | | | |
|---|---|---|---|---|---|
| 4,549,377 | A | * | 10/1985 | Castle | 52/94 |
| 4,800,689 | A | * | 1/1989 | Lane | 52/60 |
| 5,927,023 | A | * | 7/1999 | Kittilstad | 52/60 |
| 6,578,322 | B2 | * | 6/2003 | Kintop | 52/96 |

* cited by examiner

*Primary Examiner*—Carl D. Friedman
*Assistant Examiner*—Jennifer I. Thissell
(74) *Attorney, Agent, or Firm*—Mills Law Firm PLLC

(57) ABSTRACT

A facia border for covering the periphery of a structure between the roof and a soffit includes mounting clips attached at periodic peripheral locations for attaching coil facia trim at detented positions.

17 Claims, 6 Drawing Sheets

FACIA BORDER

FIELD OF THE INVENTION

The present invention relates to facia borders for use around the periphery of a building roof, and, in particular, to a two-piece facia system for easy and accurate installation between the roof and soffits.

BACKGROUND OF THE INVENTION

Facia borders are commonly used at the transition of outer walls and roof periphery to provide a structural and architectural transition therebetween. Where a transition is to be effected between a soffit and the roof, for instance, an elongate strip or board is attached to the nailing plate on the outer wall and overlies the upper end thereof. A molding strip is oftentimes used to provide the final transition with the roof.

The installation using lumber is well established. The material is relatively rigid and presents few problems in alignment or fastening. The advent of light weight prefinished materials, such as aluminum trim strips, however, present installation, quality control, and decorative problems. The trim strips are commonly roll-formed on site from coiled stock and severed to convenient extended lengths and nailed at the upper ends to the underlying nailing plate. Because of the thin wall material commonly used, 20 gauge or less in thickness, the formed strips are prone to deflection and sagging during installation, presenting an undesirable waviness at the bottom detracting from appearance. Unless carefully handled, the strips may also kink or buckle, further complicating installation and detracting from appearance. Thus, unless painstakingly matched to reference markings requiring advance carpentry skills, the finished border is irregular and decoratively compromised.

Further, the fastener installation tends to impart localized surface blemishes, in the form of dimples and waves, which are likewise detracting. Moreover, the rigid attachment of the trim strip presents thermal expansion problems that can produce bowings and other thermally related distortions of the trip strip. Not entirely satisfactory attempts have been made to overcome the attachment difficulties using adhesives, however, durability and long term adherence problems persist.

Facia systems have been proposed using custom components, in both aluminum ad vinyl stock. For instance, U.S. Pat. No. 6,227,797 to Finger discloses a rake board installation wherein upper and lower J-channels capture inwardly projecting hooks at the top and bottom of a trim piece. A similar custom retention system is disclosed in U.S. Pat. No. 4,461,129 to Knoebl wherein upper and lower mounting channels capture the facia panel. Another mounting system is disclosed in U.S. Pat. No. 3,332,180 to Price wherein spaced mounting clips engage the lower flange of a trim member, with the upper end of the trim member nailed to the roof sheeting. While each of the foregoing eliminates some of the drawbacks of current facia installation, custom and according expensive components are required.

SUMMARY OF THE INVENTION

The present invention provides a snap-in facia border utilizing conventional roll formed coil trim. The trim is attached to mounting clips periodically spaced about the roof periphery. The mounting clip includes horizontal barbs that are tacked on the nail backing plate along a chalk line that insures uniform positioning of the trim relative to the roof line, soffit and wall facing. After alignment the clip is attached to the nailing plate with conventional fasteners. The clip includes an upper pocket that receives the top of the trim to vertically locate and retain the trim, and a lower leg that is slidably received in the lower trim flange to retain the bottom of the trim. The front face is provided with rearward swaged indentations that engage a stop plate to limit downward movement of the trim. The trim may be conveniently slid into a locked condition whereat the indentations detent with the stop plates of the mounting clips, easily and with minimal dexterity. Resultantly, an accurately aligned trim member using desirable standard trip components is provided.

Accordingly, it is an object of the present invention to provide a facia system for roof borders that is easy to install using conventional trim facing.

Another object of the invention is to provide a simplified method for accurately installing coil trim.

A further object of the invention is to provide a two-piece facia border for a roof periphery that is easily, accurately and securely assembled without visible fasteners.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 2:
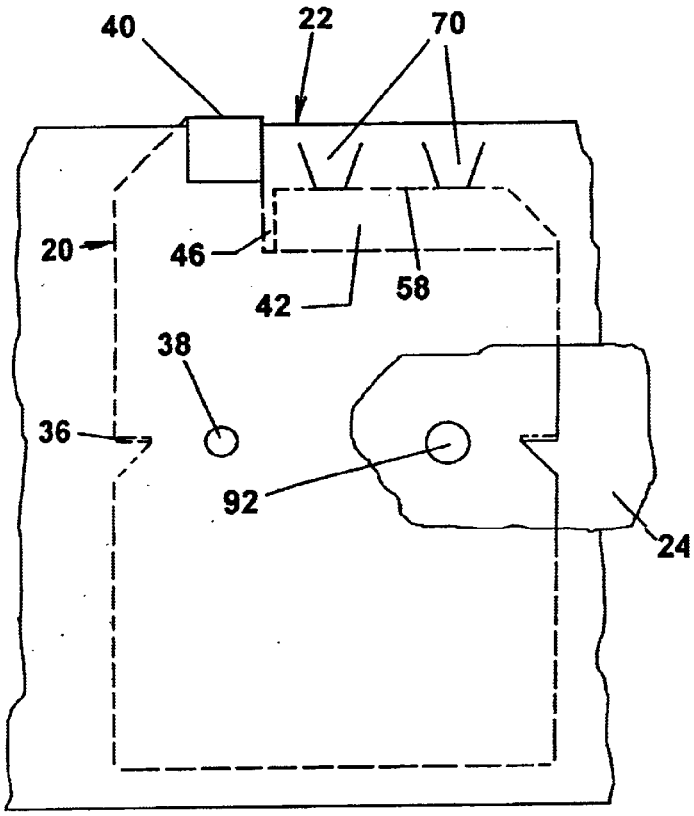
FIG. 2 is a fragmentary front view of the facia border shown in FIG. 1.
Figure 1:
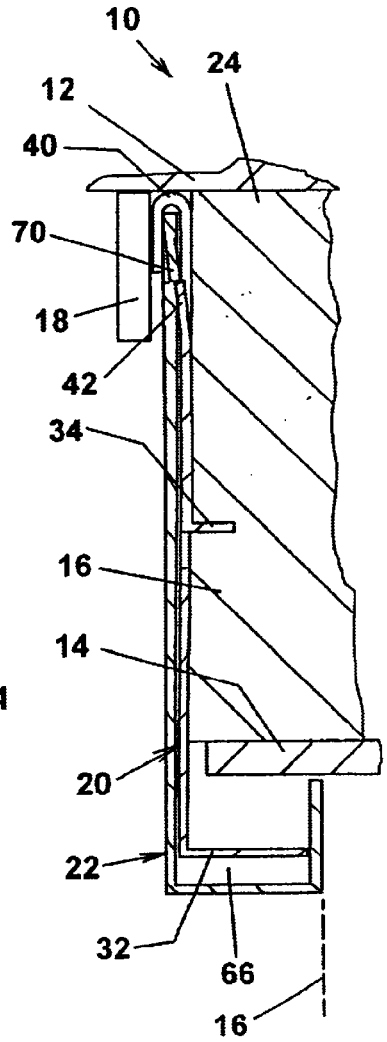
FIG. 1 is a side cross sectional view of a facia border in accordance with a preferred embodiment of the invention.

Referring to the drawings for the purpose of describing the preferred embodiment and not for limiting same, FIG. 1, and 2 illustrate a facia border 10 disposed about the periphery of a structure between a roof member 12 and a horizontal soffit 14, or wall facing 16, shown in dashed lines. In final assembly, the top end of the facia border 10 is commonly overlaid by corner molding 18. As a result, the facia border 10 forms a decorative facing for the transitions between structure walls and roofing.

Figure 8:
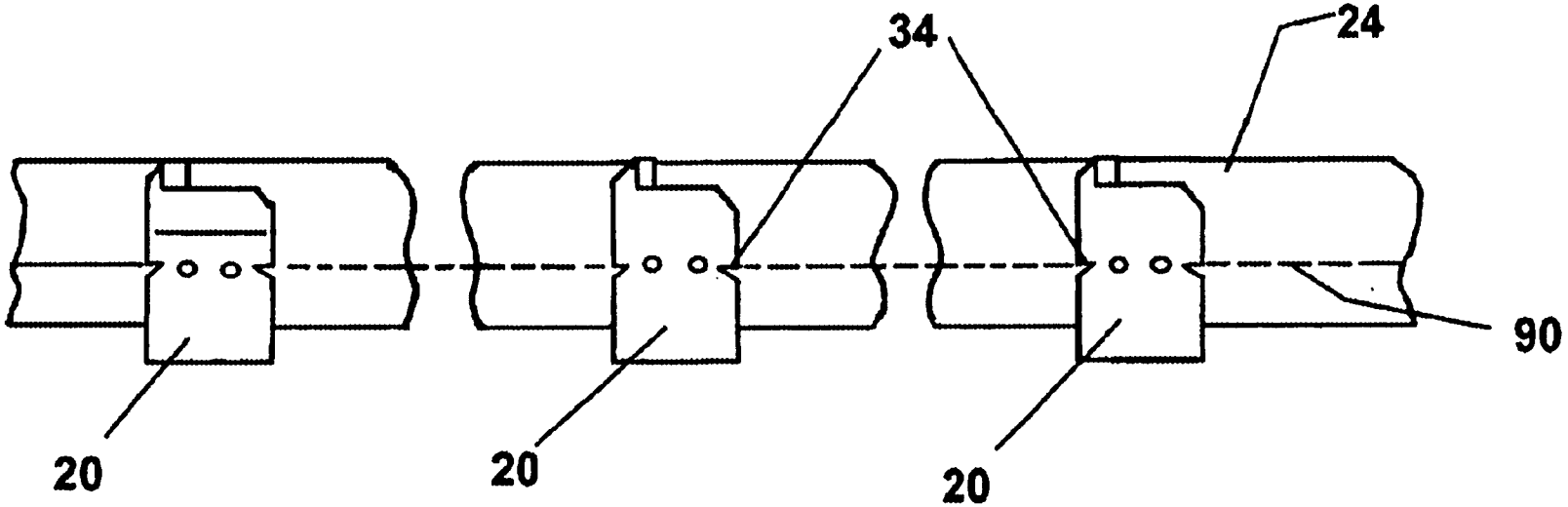
FIG. 8 is fragmentary front elevational view of the mounting clips installed on a nailing plate.

The facia border 10 comprises a plurality of mounting clips 20 to which an elongated trim strip 22 is slidably secured. As shown in FIG. 8, the clips 20 are periodically attached to a nailing plate 24, customarily 16 inch to 24 inch on center spacings. The nailing plate 24 is typically dimensional lumber, 2×4 or 2×6.

Figure 5:
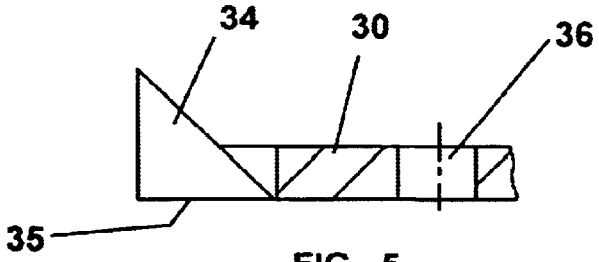
FIG. 5 is an enlarged fragmentary cross sectional view of the mounting clip illustrating the clip locating barb.
Figure 3:
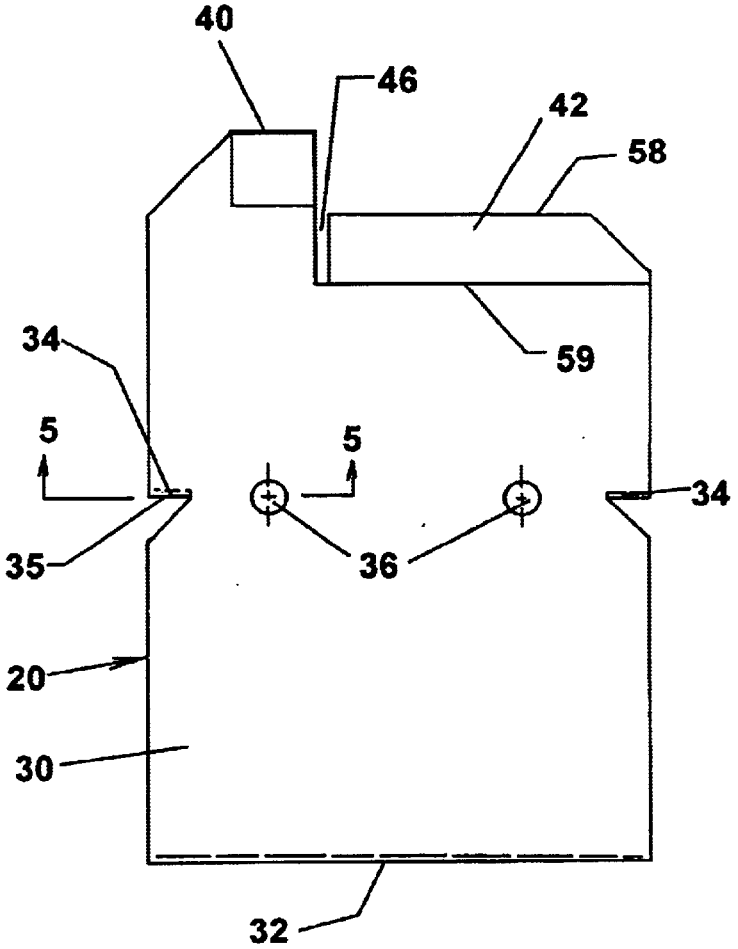
FIG. 3 is a front view of the facia clip for the facia border shown in FIG. 1.
Figure 4:
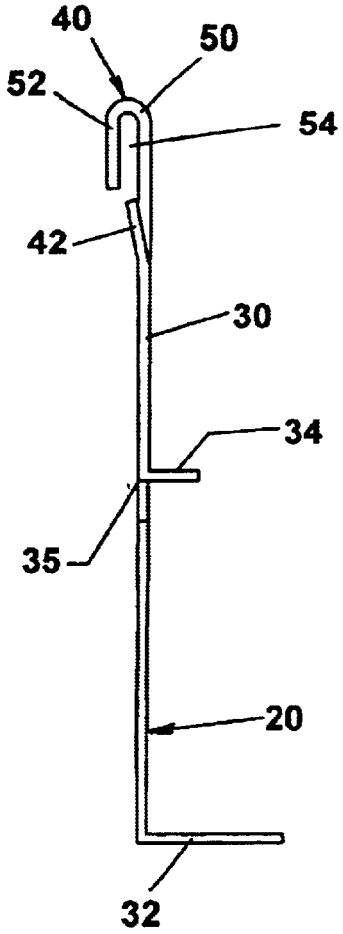
FIG. 4 is a side view of the facia clip shown in FIG. 3.
Figure 7:
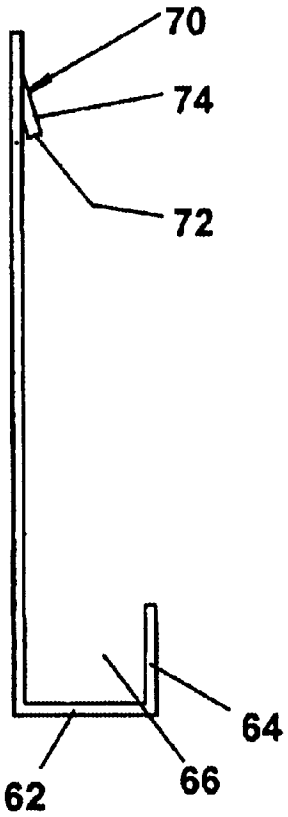
FIG. 7 is a side view of the facia panel shown in FIG. 6.
Figure 6:
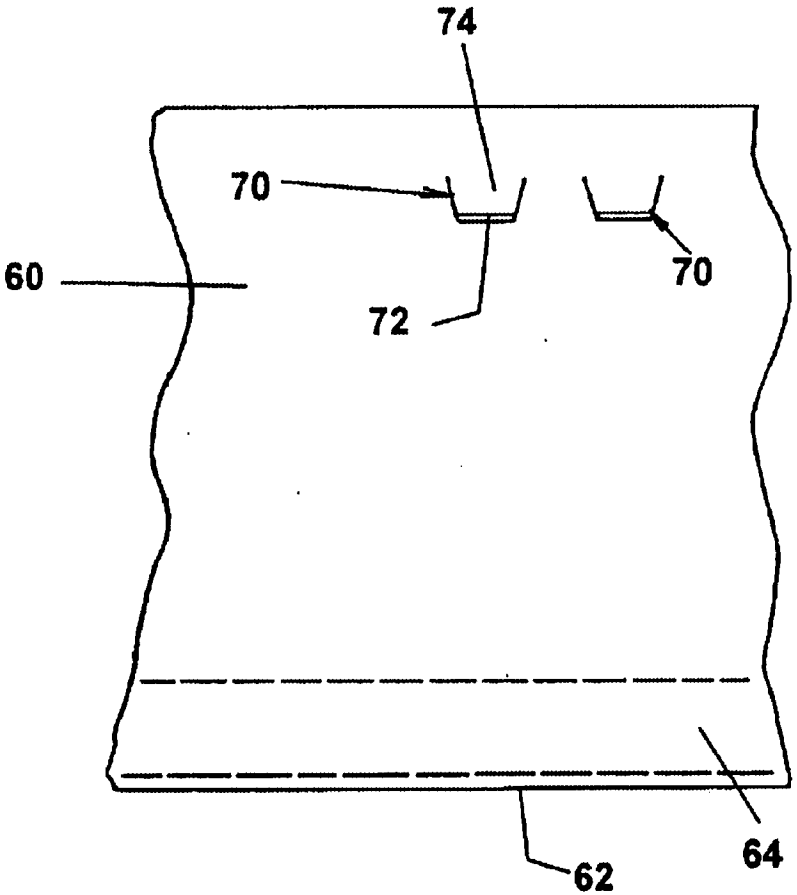
FIG. 6 is a fragmentary front view of the facia panel of the facia border shown in FIG. 1.

Referring to FIGS. 3 through 5, the mounting clip 20 comprises a unitary body formed of sheet material. The mounting,clip 20 includes a vertical front wall 30 and a rearwardly turned lower horizontal wall 32 at the lower end thereof. A pair of triangular reversely bent barbs 34 are formed at the sides of the front wall 30 and project rearwardly orthogonal thereto. The barbs 34 are horizontally aligned along a horizontal fold line 35 and spaced in about the middle of the front wall 32. A pair of circular nailing holes 36 are formed in the front wall 30 inwardly of and with axes horizontally aligned with the barbs 34. The front wall 30 has parallel vertical side walls and terminates upwardly with a reversely bent clip pocket 40 and a forwardly inclined stop plate or tab 42. The upper corners of the front wall are provided with beveled surfaces. The pocket 40 and the locating tab 42 are horizontally separated by a vertical gap 46.

The pocket 40 is defined by a reversely bent, U-shaped rim 50 and a generally rectangular frontal wall 52, forwardly spaced from the front surface of the wall 30 to define a downwardly opening slot 54. The stop tab 42 is forwardly inclined about a horizontal fold line 56 presenting a top horizontal locating ledge 58. The tab 42 is inclined sufficiently for locking with the trim 22 as described in greater detail below. The tab is inclined between 0° and 20° and preferably between 5° and 15°, with good retention being provided with an inclination of about 10°. The lower wall 32 has a length for establishing a sliding fit with the trip strip as described below.

The trim strip 22 is a conventional elongate member formed in preformed lengths, or roll formed from coiled strip on-site to working lengths. The trim strip 22 has a L-shaped side profile comprising a front wall 60 having a rearwardly extending bottom wall 62 terminating with a reversely upwardly turned lip 64. The inner surfaces of the front wall 60, the bottom wall 62 and the lip 64 define an upwardly opening slot 66 having a width for slidably receiving the lower wall 32 of the mounting clip 20.

The front wall 60 may be formed of varying conventional configurations and textures for architectural preferences. In the present invention, the front wall 60 includes horizontally spaced, rearwardly projecting locating indents 70. The indents 70 may be arranged in pairs that are longitudinally spaced along the length of the facia board corresponding to the spacing of the mounting clips 20. If arranged in the illustrated pairs, the spacing is less than the length of the inclined ledge 58. The indents 70 may be formed by a suitable metalworking crimping device, such as a commercially available Snap-Loc crimper. Each indent 70 is generally defined by a severed lower horizontal edge 72, which is rearwardly spaced from the front wall by a rearwardly swaged inclined transition wall 74. Accordingly, the locating edge 72 forms a rearwardly indented surface for engagement with the edge 58 of the mounting clip 20. The locating edge 72 is slightly less than the distance between the pocket 40 and the ledge of the mounting clip such that when the upper end of the facia board is received in the pocket 54, the indent 70 engage the ledge 58 to vertically locate the trim strip with respect to the mounting clip. The distance between the indents 70 and the lower wall 62 is substantially the same or less than the distance between the ledge 58 to the lower wall 32 of the clip.

The facia border 10 as described above may be readily and accurately assembled around the roof perimeter. Initially, as shown in FIG. 8, a chalk line 90 is established a predetermined distance above the lower edge of the nailing plate, representing a distance whereat the lower end of the trim strip is preferably disposed. The barbs 34 of the mounting clips are located at desired periodic spacings along the line 90. The barbs are tacked into place to align the clips. Suitable fasteners, such as nails or screws, are installed through the plate holes 36 to fixedly secure the clips 20 to the nailing plate 24.

Figure 9:
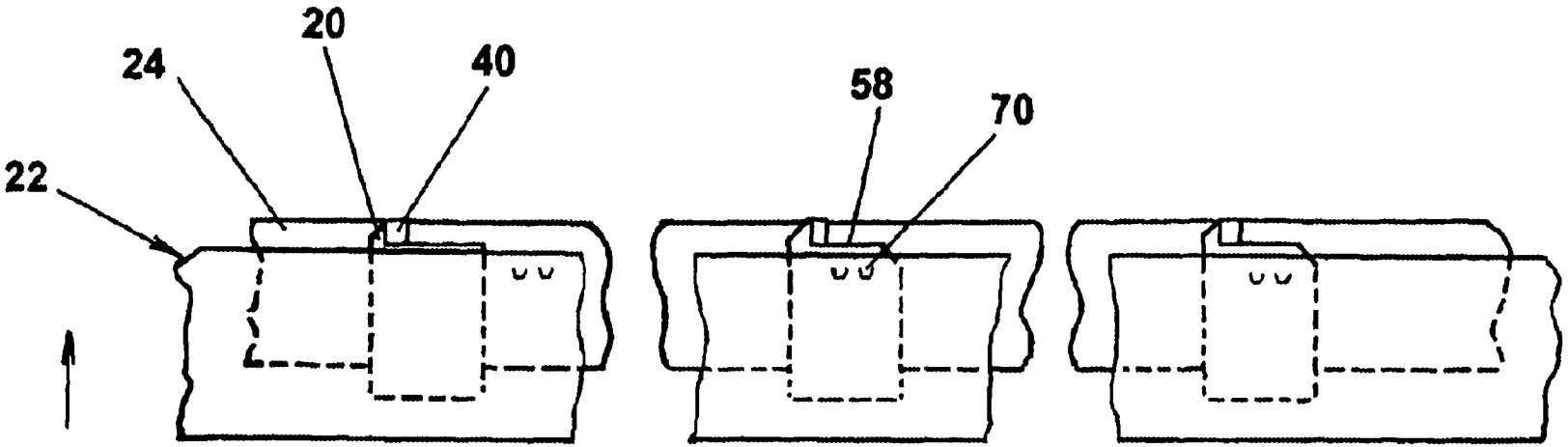
FIG. 9 is a view similar to FIG. 8 showing the facia plate on the facia clips prior to locking.
Figure 11:
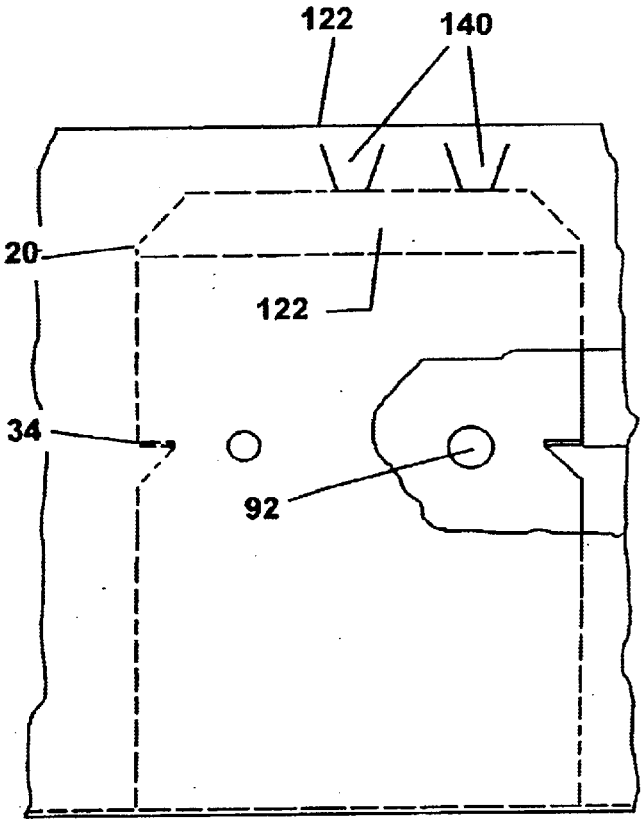
FIG. 11 is a fragmentary front view of the facia border shown in FIG. 11.
Figure 10:
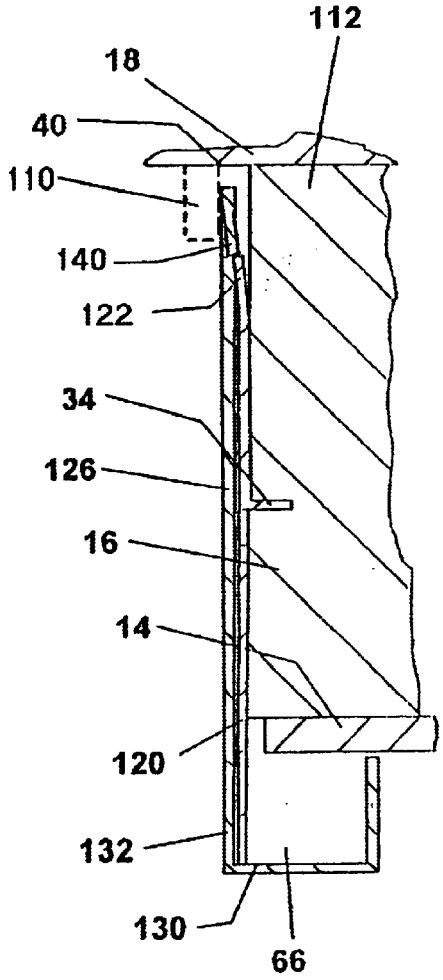
FIG. 10 is a side cross sectional view of a facia border in accordance with another embodiment of the invention.

Referring to FIG. 9, after installation of the clips, the trim strip 22 preliminary horizontally positioned on the clips with the indents aligned with the stop plate and the slot 64 aligned with the lower wall 32. The trip strip 22 is further vertically raised as indicated by the arrow with the upper end entering the clip pocket 40, the indents 70 resiliently snapping over the lip, and the lower wall telescoping in the pocket resulting in the assembled conditions shown in FIGS. 1 and 2. Thereat, the vertical positions are repetitively accurately maintained, and inward and outward movement restrained at the top end, by the upper pocket and at the lower end by the cooperation between the lower wall and the lower slot Another embodiment of the invention is shown in FIGS. 10 and 11 particularly adapted for installations wherein the facia corner molding 110 is installed to the nailing plate 112 prior to trim strip installation. Therein, the mounting clip 120 includes a top portion defined by a forwardly inclined tab 122 providing a horizontal locating surface 124 along the upper edge eliminating the top pocket of the above embodiment. The length of the front wall 126 is increased to provide direct contact with the lower wall 130 of the facia board 132. The clip 120 is installed similar to the above embodiment. For installation, the top end of the trim strip 132 is upwardly inserted between the corner molding 110 and the nailing 112 until the indents 140 snap over the edge of the stop plate 122 thereby establishing a locked position against downward movement. Vertical upward movement is restrained by engagement of the lower end 142 of the clip with lower flange of the trip strip. Inward and outward movement of the top of the trim strip is restrained by corner molding. If desired to restrain inward and outward movement of the bottom of the facia board, the clip 120 may be provided with a rearward lower leg for receipt in the lower slot of the facia board, similar to the first described embodiment.

It will thus be appreciated that the present invention provides a nail free mounting for roof facia board that can be easily and quickly installed to precise standards without requiring high skill levels. Once in place, the retention features establish secure retention while allowing thermal expansions and contractions without warping or wrinkling, and resist outer deflection occasioned by winds and precipitation.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A facia border for mounting on a vertical peripheral plate surrounding a roof of a structure at an upper end and a horizontal soffit at a lower end, said facia border comprising:

a plurality of mounting clips, each of said mounting clips including a front panel having lateral reversely formed rearwardly projecting barbs engagable with the plate for securing the mounting clip thereto at periodic longitudinally aligned mounting positions, a frontally reversely formed lip formed at the top of said front panel defining a downwardly opening slot, a plurality of apertures in said front panel for receiving fasters for fixed attachment of said clip to the plate, a stop member on said front panel adjacent said lip and therebelow a predetermined distance, a rearwardly directed horizontal flange at the lower end of said panel disposed below the soffit at the mounting position; and a facia member overlying said mounting clips having an upper end located in said downwardly opening slots in said mounting clips for limiting outward and upward movement of said facia member, a bottom slot at a lower end receiving said flanges of said mounting clips in said mounting position for limiting outward movement of said facia member relative to said mounting clips, and detent means formed in said facia member providing rearwardly extending projections below said upper ends of said front panels at about said predetermined distance and engaging said stop member to limit downward movement of said facia member relative to said clips.

2. The facia border as recited in claim 1 wherein said stop member is forwardly and upwardly inclined with respect to said front panel of said mounting clip.

3. The facia border as recited in claim 2 wherein said stop member is inclined about 5 to 20 degrees.

4. The facia border as recited in claim 1 wherein said holes are aligned with said barbs.

5. The facia border as recited in claim 4 wherein said barbs are triangular.

6. The facia border as recited in claim 5 wherein said stop surface is parallel to said slots.

7. The facia border as recited in claim 6 wherein said detent means are generally rectangular tab members member inclined downwardly and rearwardly on said facia member and longitudinally aligned.

8. The facia border as recited in claim 7 wherein said tab members have horizontal stop surface severed from said facia member and located rearwardly thereof for engagement with said stop members.

9. A facia border assembly, comprising:

a roof member and a wall member;

a fastening member on the peripheral structure between said roof member and said wall member;

clip members attached to said fastening member at periodic aligned spacings, said clip member having a horizontal upper stop member at the upper end and a horizontal lower stop member at the lower end, and locating means associated with said fastening member and said clip members for locating said upper stop member in a mounting position at a controlled vertical distance on said fastening member;

an elongated trim member having a front wall overlying said fastening member and said clip members and extending below said lower stop member, a rearwardly directed horizontal flange at the lower end of said front wall in the mounting position and a rearwardly extending surface below an upper end of said trim member at about said predetermined distance for engaging said upper stop members to limit downward movement of said facia member relative to said clip members.

10. The facia border assembly as recited in claim 9 wherein said rearwardly extending surface comprises a periodic longitudinal series of indents formed adjacent the upper end of said trim member.

11. The facia border assembly as recited in claim 10 wherein said indents are defined by rearwardly extending severed surfaces for engaging said stop members.

12. The facia border assembly as recited in claim 11 wherein said indents are formed by a crimping device.

13. The facia border assembly as recited in claim 9 wherein said locating means comprises rearwardly extending barbs.

14. The facia border assembly as recited in claim 9 wherein said locating means comprise laterally spaced aligned apertures, and fasteners extending through said apertures for attaching said clip members to said fastening member.

15. A method of mounting a facia border on a peripheral surface of a structure adjacent the roof, comprising the steps of:

providing a mounting clips having a plurality of aligned barbs;

providing a straight line on said peripheral surface a predetermined distance above the lower edge thereof;

aligning said barbs at said straight line;

embedding said barbs into said peripheral surface to attach said mounting clips thereto;

fixedly attaching said mounting clips to said peripheral surface;

providing an upper forwardly reversely turned arm on the upper ends of said mounting clips terminating adjacent the upper edge of said peripheral surface, said reversely turned arm providing a downwardly opening slot;

providing a lower rearwardly reversely turned leg at the lower end of said mounting clip and extending below said peripheral surface;

providing a stop surface at the upper end of said mounting clip intermediate said barbs and said slot;

providing a trim member having a front wall overlying said mounting clips with an upper end located in said slots in a mounting position;

providing a rearwardly reversely turned member at a lower end of said trim member having an upwardly opening lower slot for receiving said legs of said clips at said mounting position;

providing rearwardly indented portions on said trim member engaging said stop surfaces in said mounting position;

locating said trim member on said mounting clips with the upper end below said slots and said indented portions aligned with said stop surfaces; and sliding said trim member upwardly on said mounting clips with said upper end entering said slots and said indented portions passing over said stop surfaces for detented engagement therewith at said mounting position.

16. The facia border assembly as recited in claim 15 wherein said barbs are formed at the sides of said clip members.

17. A method of mounting a facia border on a vertical peripheral surface of a structure adjacent the roof, comprising the steps of:

providing a plurality of mounting clips having an upper stop surface and a lower stop surface;

providing a straight line on said peripheral surface above the lower edge thereof;

providing a transverse locating reference indicia on said mounting clips to locate said upper stop surface a controlled vertical distance thereabove and said lower stop surface a controlled vertical distance therebelow;

attaching said mounting clips at period longitudinal locations on said peripheral surface with said locating reference indicia on said mounts clips aligned with said straight line on said peripheral surface;

providing a front retaining member extending downwardly from said roof member and forwardly spaced from said peripheral surface to provide a downwardly opening slot;

providing a trim member having a front wall overlying said mounting clips with an upper end located in said downwardly opening slot in a mounting position;

providing rearwardly reversely turned member at a lower end of said trim member engagable with said lower stop surfaces on said mounting clips for limiting upward movement on said trim member and outward movement of the lower end on said trim member from said mounting position;

providing a rearwardly extending surface adjacent the upper end of said trim member engagable with said upper stop surfaces of said clips to limit downward movement of said trim member in the mounting position;

locating said trim member on said mounting clips with the upper end below said downwardly opening slot and said rearwardly extending surface aligned with said upper stop members; and sliding said trim member upwardly on said mounting clips with said upper end entering said downwardly opening slot and said rearwardly extending surface passing over said upper stop members for detented engagement therewith at said mounting position.

* * * * *